US010391460B2

(12) United States Patent
Hanada et al.

(10) Patent No.: US 10,391,460 B2
(45) Date of Patent: Aug. 27, 2019

(54) FLUID MIXER AND APPARATUS USING FLUID MIXER

(71) Applicant: ASAHI YUKIZAI CORPORATION, Nobeoka-shi, Miyazaki (JP)

(72) Inventors: Toshihiro Hanada, Nobeoka (JP); Takahiro Okada, Tokyo (JP)

(73) Assignee: ASAHI YUKIZAI CORPORATION, Nobeoka-shi, Miyazaki (JP)

( * ) Notice: Subject to any disclaimer, the term of this patent is extended or adjusted under 35 U.S.C. 154(b) by 224 days.

(21) Appl. No.: 15/516,343

(22) PCT Filed: Oct. 2, 2015

(86) PCT No.: PCT/JP2015/078099
§ 371 (c)(1),
(2) Date: Mar. 31, 2017

(87) PCT Pub. No.: WO2016/052742
PCT Pub. Date: Apr. 7, 2016

(65) Prior Publication Data

US 2017/0304787 A1 Oct. 26, 2017

(30) Foreign Application Priority Data

Oct. 3, 2014 (JP) ..... 2014-204685

(51) Int. Cl.
*B01F 3/08* (2006.01)
*B01F 5/06* (2006.01)
*B01F 15/00* (2006.01)

(52) U.S. Cl.
CPC ..... *B01F 5/0658* (2013.01); *B01F 3/0861* (2013.01); *B01F 5/0619* (2013.01);
(Continued)

(58) Field of Classification Search
CPC ..... B01F 15/00935; B01F 2005/0627; B01F 2005/0637; B01F 3/0861; B01F 5/0619; B01F 5/0644; B01F 5/0656; B01F 5/0658
See application file for complete search history.

(56) References Cited

U.S. PATENT DOCUMENTS 2,740,616 A * 4/1956 Walden ..... B01D 11/043 181/264
2,965,362 A * 12/1960 Flottmann ..... B01F 3/0807 236/1 E (Continued)

FOREIGN PATENT DOCUMENTS

JP 2000-140595 A 5/2000
JP 2001-029764 A 2/2001

(Continued)

OTHER PUBLICATIONS

Search Report for European Patent Application No. 15847431.2, dated May 4, 2018.

(Continued)

*Primary Examiner* — Tony G Soohoo
(74) *Attorney, Agent, or Firm* — Merchant & Gould P.C.

(57) ABSTRACT

A fluid mixer of the present invention has an element (1) and a chassis (2) that accommodates the element therein and that is engaged with at least both ends of the element, the element having: a first-flow-path forming section (13) at an end of which a fluid inlet (3) is formed and in which a first flow path (4) is formed; and a body section (12) at an end of which a fluid outlet (8) is formed, in which a second flow path (5) is formed, and on an outer circumferential surface of which a plurality of communicating holes (11) are formed so as to allow the second flow path to communicate with the outside. A plurality of delay members (9) are discontinuously formed in a flow-path axial direction on at least one of an inner circumferential surface of the chassis and the outer circum- (Continued)

ferential surface of the body section, a single continuous space is formed between the inner circumferential surface of the chassis and the outer circumferential surface of the body section, the space serves as a third flow path (6), and the communicating holes serve as branch flow paths (7).

16 Claims, 9 Drawing Sheets

(52) U.S. Cl.
CPC ..... *B01F 5/0644* (2013.01); *B01F 5/0656* (2013.01); *B01F 15/00935* (2013.01); *B01F 2005/0627* (2013.01); *B01F 2005/0637* (2013.01)

(56) References Cited

U.S. PATENT DOCUMENTS 3,089,683 A * 5/1963 Adams ..... B01F 3/10 138/42
3,190,618 A * 6/1965 Katzen ..... B01F 5/0619 366/337
3,427,002 A * 2/1969 Wilding ..... B01F 3/0869 138/42
3,470,912 A * 10/1969 Bydal ..... B01F 5/064 137/1
3,715,105 A * 2/1973 Griffin ..... B01F 5/0656 366/279
3,941,355 A * 3/1976 Simpson ..... B01F 5/0656 366/99
4,164,266 A * 8/1979 Collin ..... F01N 1/003 181/250
4,305,672 A * 12/1981 Adams ..... B01F 5/0644 366/336
4,340,311 A * 7/1982 Crandal ..... B01F 5/0644 138/42
4,361,407 A * 11/1982 Pellegrini ..... B01F 5/0644 366/340
4,514,095 A * 4/1985 Ehrfeld ..... F16L 55/02718 138/42
4,591,274 A * 5/1986 Sulin ..... B29C 45/581 366/336
4,994,242 A * 2/1991 Rae ..... B01F 5/0256 138/37
5,863,129 A * 1/1999 Smith ..... B01F 5/0644 138/42
6,447,158 B1 * 9/2002 Farkas ..... B01F 5/0471 366/169.1
8,827,544 B2 * 9/2014 Bachman ..... B01F 3/0446 366/167.1
2016/0001240 A1 1/2016 Okada et al.
2017/0304787 A1 * 10/2017 Hanada ..... B01F 3/0861

FOREIGN PATENT DOCUMENTS

JP 2001-205062 A 7/2001
JP 2008-220634 A 9/2008
JP 2011-104482 A 6/2011
JP 2011-161323 A 8/2011
WO 2014/129548 A1 8/2014

OTHER PUBLICATIONS

International Search Report for PCT/JP2015/078099 (dated Dec. 8, 2015).

* cited by examiner

FLUID MIXER AND APPARATUS USING FLUID MIXER

This application is a U.S. National Stage Application under 35 U.S.C. § 371 of International Patent Application No. PCT/JP2015/078099 filed Oct. 2, 2015, which claims the benefit of priority to Japanese Patent Application No. 2014-204685 filed Oct. 3, 2014, the disclosures of all of which are hereby incorporated by reference in their entireties. The International Application was published in Japanese on Apr. 7, 2016 as WO 2016/052742.

TECHNICAL FIELD

The present invention relates to fluid mixers used for fluid transporting pipes in various industries such as chemical factories, the semiconductor manufacturing field, the food field, the medical field, and the biological field. In particular, the present invention relates to: a fluid mixer that can mix and stir a fluid so as to uniformly homogenize the concentration distribution and temperature distribution of the fluid in a flow direction; and an apparatus using the fluid mixer.

BACKGROUND

Conventionally, a method using a twisted-blade-shaped static mixer element 101 mounted in a pipe as illustrated in FIG. 12 has been common as a method for homogeneously mixing a fluid flowing in the pipe (see, for example, Patent Literature 1). Typically, the static mixer element 101 has a structure in which a plurality of minimum unit members, each of which is obtained by twisting a rectangular plate at 180 degrees about the longitudinal axis of the rectangular plate, are connected together in series so that the directions of the twisted minimum unit members are alternately different. The static mixer element 101 is arranged in a pipe 102, male connectors 103 are attached to both ends of the pipe 102, flares 105 are mounted, and clamping nuts 104 are screwed, whereby a static mixer is formed. In such a case, the outer diameter of the static mixer element 101 is designed to be approximately equal to the inner diameter of the pipe 102 to effectively stir fluid.

CITATIONS LIST

Patent Literature

Patent Literature 1: Japanese Unexamined Patent Application Publication No. 2001-205062

SUMMARY OF INVENTION

Technical Problem

Since the method for mixing fluid using the conventional static mixer includes stirring flowing fluid along the stream, the concentration distribution in the radial direction Dd of the pipe can be uniformly homogenized, as illustrated in FIG. 13A. However, the method is incapable of uniformly homogenizing the concentration distribution in the axial direction (flow direction) Fd of the pipe as illustrated in FIG. 13B. Therefore, for example, when water and a chemical liquid are mixed in an upstream part of the static mixer and set to flow, the mixture passes through the static mixer in a state in which the concentration of the chemical liquid is partially high in a flow passage, if the mixture ratio of the chemical liquid temporarily increases. In such a case, even if the water and the chemical liquid are stirred and homogenized in the radial direction Dd, a portion in the flow passage having a partially high concentration flows to the downstream side with having the high concentration in the axial direction (flow direction) Fd of the pipe, without being diluted (see FIG. 13B). As a result, if the static mixer is connected to a semiconductor washing apparatus, in particular an apparatus that directly applies a chemical liquid to a surface of a semiconductor wafer to perform various kinds of treatment, there would be a problem that the chemical liquid having non-uniform concentration is applied to the surface of the semiconductor wafer and thereby causing a defective product.

Examples of methods for avoiding the unevenness of the concentration distribution in the axial direction (flow direction) of the pipe include a method in which a tank is installed at some midpoint in the flow passage, the fluid is temporarily stored in the tank, the concentration in the tank is homogenized, and the fluid is then allowed to flow (not illustrated). However, there are problems that: a large space is necessary in order to install the tank, thereby resulting in a large apparatus; the number of members that are used increases because a pump, a pipe, and the like are additionally required in order to re-transport the fluid from the tank; and which results in additional cost for installing a pipe line. Further, fluid may remain in the tank in the method. There is a problem that the fluid that remains in the tank may generate bacteria in the tank which flows into the pipe line and adheres to a semiconductor wafer in a semiconductor manufacturing line, thereby resulting in a defective product.

The present invention was made in view of the problems of such conventional technologies as described above, with an object to provide a fluid mixer with a compact structure, capable of mixing and stirring the fluid so that the concentration distribution and temperature distribution in the flow direction of fluid are uniformly homogenized.

Solution to Problem

In accordance with the invention of claim 1, there is provided a fluid mixer comprising: a fluid inlet; a first flow passage that is connected to the fluid inlet; a second flow passage that is arranged so as to communicate with or be partitioned from the first flow passage and that is arranged to share the same central axis with the first flow passage; a third flow passage that is connected to the first flow passage and that is arranged to an outer periphery of the second flow passage; a plurality of branching flow passages that branch from the third flow passage and that are connected to the second flow passage; and a fluid outlet that is connected to the second flow passage, wherein the plurality of branching flow passages branch from different positions in the third flow passage, respectively, and are connected to the second flow passage at different positions in the second flow passage, respectively; the fluid mixer comprises: an element comprising: a first flow passage forming part at an end of which the fluid inlet is formed and in an inside of which the first flow passage is formed; and a main body at an end of which the fluid outlet is formed, in an inside of which the second flow passage is formed, and on an outer peripheral surface of which a plurality of communication holes are formed to allow the second flow passage and the outside to communicate with each other; and a housing in an inside of which the element is housed and which engages with at least both ends of the element; a plurality of delaying members are discontinuously formed on at least one of an inner peripheral surface of the housing or an outer peripheral surface of the main body in a flow passage axis direction; a single continuous space is formed between the inner peripheral surface of the housing and the outer peripheral surface of the main body, the space serving as the third flow passage; and the communication holes serve as the branching flow passages.

Specifically, in the invention of claim 1, a fluid flowing through the first flow passage and the third flow passage is branched by the plurality of branching flow passages from the positions different from each other in the flow passage axis direction, and each of the branched fluids flows from positions different from each other in the flow passage axis direction into the second flow passage. Then, each of the fluids branched by the branching flow passages flows into the second flow passages with time difference, and flows out from the fluid outlet. Specifically, the fluid can be mixed so as to uniformly homogenize the concentration distribution of the fluid in a flow direction, even if the concentration of a chemical liquid temporarily increases or decreases in the fluid flowing in a flow passage upstream of the fluid mixer. As a result, fluid with a stable concentration can be supplied, and defectiveness caused by changes in the concentrations of chemical liquids can be prevented in various fields. In particular, the delaying members are formed on at least one of the inner peripheral surface of the housing or the outer peripheral surface of the main body, therefore, each of the time differences, which occur when the fluids branched by the branching flow passages flow into the second flow passage, can be increased, and the concentration distribution of the fluid in a flow direction can be uniformly homogenized more effectively. In addition, the plurality of delaying members are discontinuously formed in the flow passage axis direction, and therefore, the shapes and arrangement of the delaying members can be flexibly designed depending on the flow volume, flow rate, and properties of fluid flowing through the fluid mixer, the necessary degree of mixture, and the like. In addition, the plurality of delaying members are discontinuously formed in the flow passage axis direction, and therefore, the element can be assembled by arranging connection surfaces between the delaying members without the need of precise alignment, when the element is divisionally formed. Therefore, design and molding processing are facilitated. In addition, the fluid mixer can be compactly formed with a small number of components. The delaying member herein is an obstacle that delays a fluid that arrives at a specific location, by obstructing the flow of the fluid.

In accordance with the invention of claim 2, there is provided a fluid mixer comprising: a fluid inlet; a first flow passage that is connected to the fluid inlet; a second flow passage that is arranged so as to communicate with or be partitioned from the first flow passage and that is arranged to share the same central axis with the first flow passage; a third flow passage that is connected to the first flow passage and that is arranged to an outer periphery of the second flow passage; a plurality of branching flow passages that branch from the third flow passage and that are connected to the second flow passage; and a fluid outlet that is connected to the second flow passage, wherein the plurality of branching flow passages branch from different positions in the third flow passage, respectively, and are connected to the second flow passage at different positions in the second flow passage, respectively; the fluid mixer includes: an element including a main body at an end of which the fluid outlet is formed, in an inside of which the second flow passage is formed, and on an outer peripheral surface of which a plurality of communication holes are formed to allow the second flow passage and the outside to communicate with each other; and a housing that comprises a first flow passage forming part at an end of which the fluid inlet is formed and in an inside of which the first flow passage is formed, that houses the element therein, and that engages with at least an end of the element at which the fluid outlet is formed; a plurality of delaying members are discontinuously arranged on at least one of an inner peripheral surface of the housing or an outer peripheral surface of the main body in a flow passage axis direction; a single continuous space is formed between the inner peripheral surface of the housing and the outer peripheral surface of the main body, the space serving as the third flow passage; and the communication holes serve as the branching flow passages.

Accordingly, the invention of claim 2 can exhibit operational effects similar to those of claim 1.

In accordance with the invention of claim 3, there is provided a fluid mixer according to claim 1 or claim 2, wherein the main body is formed in a substantially truncated cone shape; and the delaying members are plate-shaped protrusions.

Specifically, since the protrusions serving as the delaying members are formed in plate shapes, many protrusions can be arranged, in particular along the flow passage axis direction, and the shapes and arrangement of the delaying members can be flexibly designed depending on fluid flowing through the fluid mixer.

In accordance with the invention of claim 4, there is provided the fluid mixer according to claim 3, wherein circumferences of the outer peripheral surface of the main body are provided with at least two protrusions, respectively; the protrusions adjacent to each other in the flow passage axis direction are arranged so that the protruding directions of the protrusions are shifted to each other in the circumferential direction; and a flow passage cross-sectional areas of the third flow passage on the circumferences gradually decrease from an upstream part to a downstream part.

Specifically, in the invention of claim 4, since the protrusions are provided on the circumferences of the outer peripheral surface of the main body, the protrusions are easily placed so as to be orthogonal to the flow passage axis, and the flow of fluid can be effectively obstructed. In addition, fluid can be allowed to frequently collide with the protrusions when the fluid flows downstream, because at least two protrusions are provided on each of the circumferences of the outer peripheral surface of the main body and the protrusions adjacent to each other in the flow passage axis direction are arranged so that the protruding directions of the protrusions are shifted to each other in the circumferential direction. In addition, the flow of fluid can be effectively obstructed, because the flow passage cross-sectional areas of the third flow passage on the circumferences on which the protrusions are provided gradually decrease from the upstream part to the downstream part.

In accordance with the invention of claim 5, there is provided the fluid mixer according to claim 3 or claim 4, wherein the main body has a step-formed shape in which a plurality of cylindrical parts having different diameters are arranged in series with central axes of the cylindrical parts that aligned so that the diameters of the cylindrical parts gradually increase from the upstream side to the downstream side.

Specifically, in the invention of claim 5, the main body can easily be formed by cutting, because the main body is formed in the step-formed shape and the outer peripheral surface of the main body is formed in a shape without a slope.

In accordance with the invention of claim 6, there is provided the fluid mixer according to any one of claim 3 to claim 5, wherein the protrusions are arranged in opposite directions with respect to the center of the circumference of the main body on which the protrusions are arranged; the widths of the protrusions are formed to be greater than the diameter of the circumference on which the protrusions are arranged; the heights of the protrusions are formed so that gaps are formed between ends of the protrusions and the inner peripheral surface of the housing; and the protrusions are arranged so that the protruding directions of the protrusions that are adjacent to each other in the flow passage axis direction are shifted circumferentially by 90° from each other.

Specifically, in the invention of claim 6, the flow of fluid flowing through the third flow passage can be more effectively obstructed, and each of the time differences, which occur when fluids branched by the branching flow passages flow into the second flow passage, can be increased.

In accordance with the invention of claim 7, there is provided the fluid mixer according to any one of claim 3 to claim 6, wherein a linear gap flow passage that does not interfere with the protrusions is formed between the inner peripheral surface of the housing and the outer peripheral surface of the main body from an upstream side to a downstream side of the main body along the flow passage axis direction.

Specifically, in the invention of claim 7, since the linear gap flow passage that does not interfere with the protrusions is formed from the upstream part to the downstream part, a part of fluid flowing through the third flow passage can flow without being obstructed by the protrusions, and a time difference can occur between the part of the fluid and the fluid that the flow thereof is obstructed by the protrusions.

In accordance with the invention of claim 8, there is provided the fluid mixer according to claim 5, wherein the protrusions are formed on steps of the step-formed shape.

Specifically, in the invention of claim 8, since the protrusions are formed on the steps of the main body formed in the step-formed shape, it is easy to position the protrusions when assembling the element by fitting the protrusions to the main body. In addition, the protrusions can be supported when the steps are positioned downstream of the protrusions.

In accordance with the invention of claim 9, there is provided the fluid mixer according to any one of claim 1 to claim 8, wherein at least the delaying members of the element has a shape that can be injection molded.

Specifically, in the invention of claim 9, the element can be efficiently produced because the delaying members are formed in shapes that can be injection molded.

In accordance with the invention of claim 10, there is provided an apparatus using a fluid mixer, the apparatus including: the fluid mixer according to any one of claims 1 to 9; and a flow passage forming means that forms a flow passage through which different fluids are joined and led to the fluid mixer.

Specifically, in the invention of claim 10, the apparatus that mixes different fluids which are frequently used can be formed by including the fluid mixer described above and the flow passage forming means.

Advantageous Effects of Invention

In accordance with the inventions according to claim 1 to claim 9, there can be provided the fluid mixer in which fluid can be mixed so as to uniformly homogenize the concentration distribution of fluid in a flow direction, even if the concentration of a chemical liquid temporarily increases or decreases in the fluid flowing in a flow passage upstream of the fluid mixer, the fluid with the stable concentration can be supplied, and defectiveness caused by changes in the concentrations of chemical liquids in various fields can be prevented.

In accordance with the invention according to claim 10, there can be further provided the apparatus that mixes various different fluids.

DESCRIPTION OF EMBODIMENTS

Figure 1:
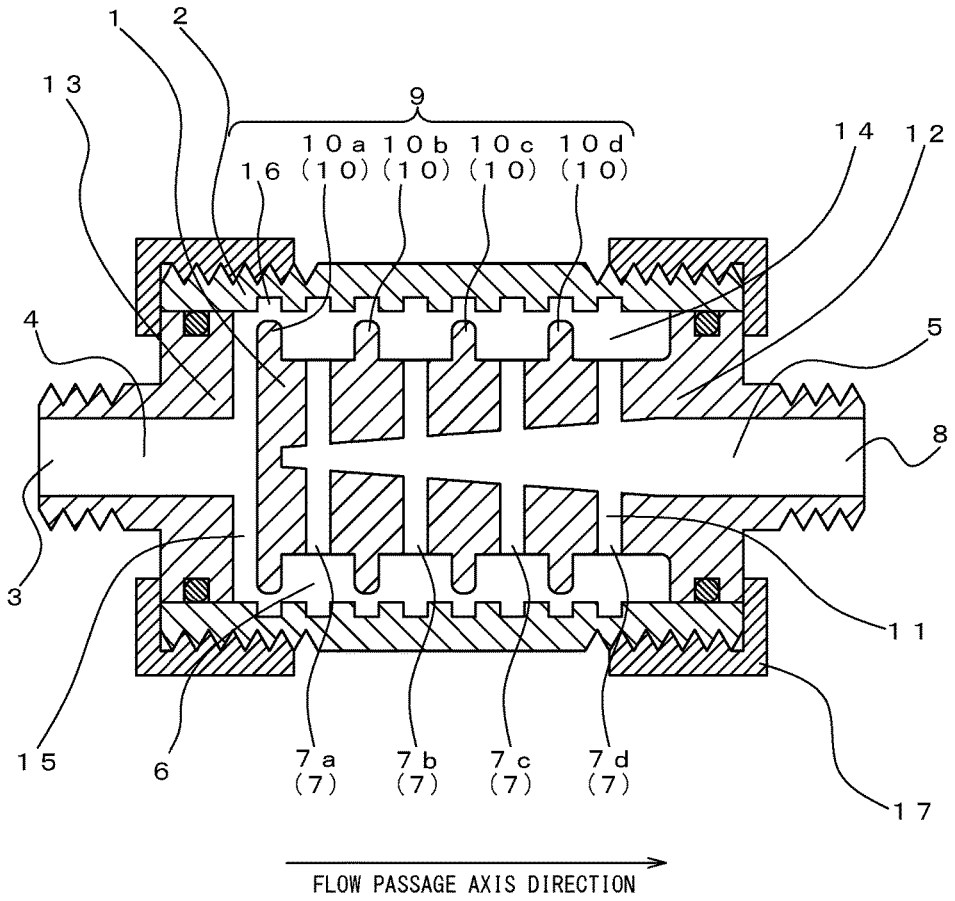
FIG. 1 is a vertical cross-sectional view illustrating the schematic configuration of a fluid mixer according to a first embodiment of the present invention.

Embodiments of the present invention will be described below with reference to examples illustrated in the drawings. However, it should be noted that the present invention is not limited to the present embodiments.

First Embodiment

A fluid mixer of a first embodiment of the present invention will be described with reference to FIGS. 1 to 4. FIG. 1 is a vertical cross-sectional view illustrating the schematic configuration of the fluid mixer according to the first embodiment. In the first embodiment, the fluid mixer including mixing flow passages is formed with an element 1 having a substantially cylindrical shape, i.e., a cylindrical shape or an approximately cylindrical shape, and a substantially cylindrically shaped housing 2 which is fitted to an outer peripheral surface of the element 1 including at least both ends thereof.

The element 1 is made of, for example, polyvinyl chloride (hereinafter referred to as PVC). In the first embodiment, the element 1 includes a first flow passage forming part 13 in which a fluid inlet 3 and a first flow passage 4 are formed, and a main body 12 in which a fluid outlet 8 and a second flow passage 5 are formed. The first flow passage forming part 13 is formed in one end of the element 1, and the fluid inlet 3 is formed on an end face of the first flow passage forming part 13, in an inside of which the first flow passage 4 connected to the fluid inlet 3 is formed. The main body 12 is formed from the midpoint of the element 1 to the other end, and the fluid outlet 8 is formed on an end face of the main body 12, in which the second flow passage 5 connected to the fluid outlet 8 is formed. The first flow passage 4 and the second flow passage 5 are linearly arranged and partitioned from each other, on the central axis of the element 1. An annular recess 14 sharing the same central axis with the element 1 is formed on an outer peripheral surface of the main body 12. A plurality of communication holes 15 that allow the annular recess 14 and the first flow passage 4 to communicate with each other are formed in one end of the annular recess 14. A third flow passage 6 is defined by a space formed between the outer peripheral surface of the main body 12 and an inner peripheral surface of the housing 2, and the communication holes 15. A plurality of communication holes 11 which serve as branching flow passages 7 allowing the second flow passage 5 and the third flow passage 6 to communicate with each other are formed in the outer peripheral surface of the main body 12 in the annular recess 14. In addition, annular protrusions 10 are formed on the outer peripheral surface of the main body 12 across the annular recess 14 from each other. The protrusions 10 are discontinuously formed as delaying members 9, described in detail later, for delaying the flow of fluid in the third flow passage 6, in the flow passage axis direction of the main body 12.

The housing 2 is made of, for example, PVC. The inner diameter of the housing 2 is formed to be substantially equal to the outer diameter of both ends of the element 1. A plurality of grooves 16 including annular grooves are formed in the inner peripheral surface of the housing 2. The grooves 16 are discontinuously formed as the delaying members 9 in the flow passage axis direction of the housing 2. Female threaded parts for screwing securing nuts 17 which hold and secure the element 1 and the housing 2 are formed on the ends of the outer peripheral surface of the housing 2. In addition, O-rings fitted into the annular grooves formed in the outer peripheral surface of both ends of the element 1 are arranged between the housing 2 and the element 1, and an interface between the housing 2 and the element 1 is maintained in a water-tight state.

The shapes of the housing 2 and the element 1 are substantially cylindrical. However, the housing 2 and the element 1 may be tubular bodies having shapes such as rectangular parallelepiped shapes, as well as the cylindrical shapes. The housing 2 and the element 1 may be fixed by any method such as welding or adhesion, as long as it is in a sealed state.

The operation of the fluid mixer of the first embodiment of the present invention will now be described.

When a chemical liquid is intermittently injected into water continuously flowing in the upstream side of the fluid mixer, and the chemical liquid mixed with the water flows in a state in which the concentration of the chemical liquid is temporarily high, the flowing chemical liquid having the partly high concentration in a flow passage flows from the fluid inlet 3 into the first flow passage 4, flows downstream, and flows into the third flow passage 6. The chemical liquid that has flowed into the third flow passage 6 passes through the communication holes 15, passes over a protrusion 10*a* formed on the main body 12, and flows downstream. When the portion having the high chemical liquid concentration flows into a section connected to a branching flow passage 7*a*, a part of the chemical liquid that has passed over the protrusion 10*a* flows through the branching flow passage 7*a*, passes through the second flow passage 5, and flows to the fluid outlet 8.

The rest of the chemical liquid passes over a protrusion 10*b*, and flows downstream. Then, the chemical liquid collides with a protrusion 10*b*, and passes through a narrow gap formed between the inner peripheral surface of the housing 2 and the protrusion 10*b*, and the flow of the chemical liquid is obstructed by a turbulent flow generated by the grooves 16 formed in the inner peripheral surface of the housing 2. Specifically, an arrival time at a branching flow passage 7*b* of the chemical liquid that has passed through the section connected to the branching flow passage 7*a* is delayed by an effect of the delaying members 9. When the portion having the high chemical liquid concentration flows into a section connected to the branching flow passage 7*b*, a part of the chemical liquid that has passed over the protrusion 10*b* flows through the branching flow passage 7*b*, passes through the second flow passage 5, and flows to the fluid outlet 8.

The rest of the chemical liquid passes over a protrusion 10*c*, and flows downstream. Then, the flow of the chemical liquid is obstructed by the protrusion 10*c* and the grooves 16, similar to the case in which the chemical liquid passes over the protrusion 10*b*. When the portion having a high chemical liquid concentration flows into a section connected to a branching flow passage 7*c*, a part of the chemical liquid that has passed over the protrusion 10*c* flows through the branching flow passage 7*c*, passes through the second flow passage 5, and flows to the fluid outlet 8. The rest of the chemical liquid passes over a protrusion 10*d*, and flows downstream. Then, the flow of the chemical liquid is obstructed by the protrusion 10*d* and the grooves 16, similar to the case in which the chemical liquid passes over the protrusion 10*c*. When a portion having a high chemical liquid concentration flows into a section connected to a branching flow passage 7*d*, the chemical liquid that has passed over the protrusion 10*d* flows through the branching flow passage 7*d*, passes through the second flow passage 5, and flows to the fluid outlet 8.

In such a case, the part of the chemical liquid having the somewhat high concentration flowing through the branching flow passage 7*a* flows the flow passage from fluid inlet 3 to the fluid outlet 8 more smoothly than the chemical liquids flowing through the other branching flow passages 7*b*, 7*c*, and 7*d*, and therefore flows out from the fluid outlet 8 earlier than the chemical liquids flowing through the other branching flow passages 7*b*, 7*c*, and 7*d*. Each of the chemical liquids flowing through the branching flow passages 7*b*, 7*c*, and 7*d* other than the branching flow passage 7*a* are interrupted from smoothly flowing by the delaying members 9 which are the protrusions 10 and the grooves 16, an arrival time at each of the branching flow passages 7 is delayed, and the chemical liquids flow out from the fluid outlet 8 with time difference in order of the chemical liquids flowing through the branching flow passage 7*b*, the branching flow passage 7*c*, and the branching flow passage 7*d*. Specifically, a flowing chemical liquid having a partly high concentration in the flow passage is divided into four portions with time differences by the fluid mixer, and then the chemical liquids flow. The chemical liquids can be mixed so that the concentration distribution in a fluid flow direction is uniformly homogenized by mixing with a chemical liquid having a less concentration.

Figure 2:
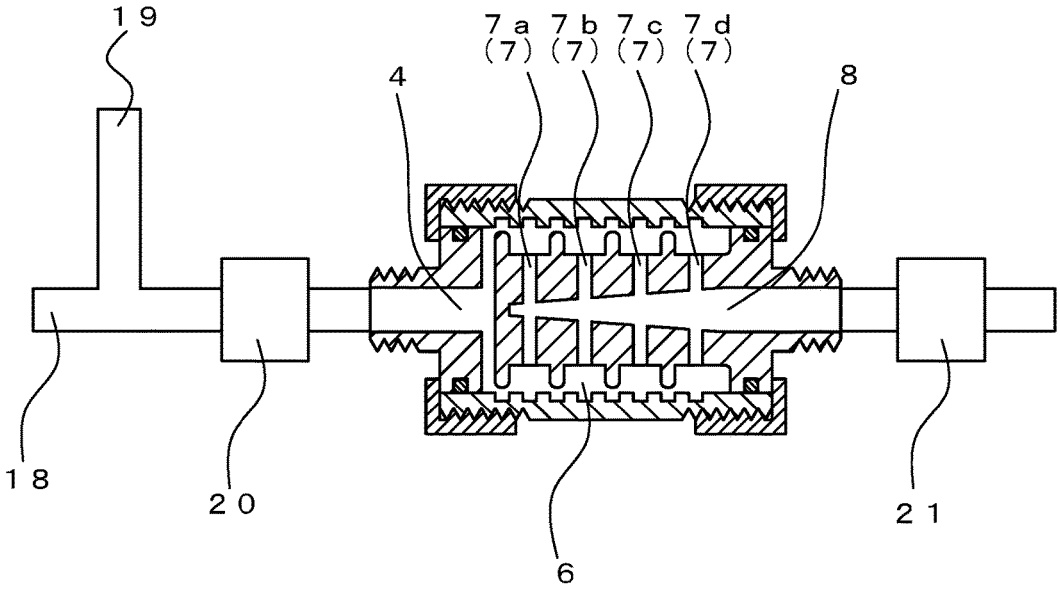
FIG. 2 is a schematic view illustrating an apparatus that measures the concentration of fluid by using the fluid mixer in FIG. 1.

The operation in which the fluid mixer divides a flowing chemical liquid having a somewhat high concentration and uniformly homogenizes the concentration distribution in the flow direction of the fluid will now be described. As illustrated in FIG. 2, in a piping system, in which the fluid mixer in FIG. 1 is arranged in a downstream of a joint part of lines 18 and 19, through which two fluids, pure water and a chemical liquid, flow, respectively, there is provided an apparatus in which concentration meters 20 and 21 are installed in the upstream and downstream sides of the fluid mixer in FIG. 1, respectively, and water and a chemical liquid are mixed to flow from the upstream side. While water and a chemical liquid are set to flow through the apparatus at a certain ratio, the concentration of the chemical liquid is temporarily increased (at an increased ratio of the chemical liquid to water). Then, the water and the chemical liquid are set to flow at the original certain ratio, thereby causing an unevenness in the concentration distribution. The concentrations in the upstream and downstream sides in such a case are measured as illustrated in FIG. 3 and FIG. 4.

Figure 3:
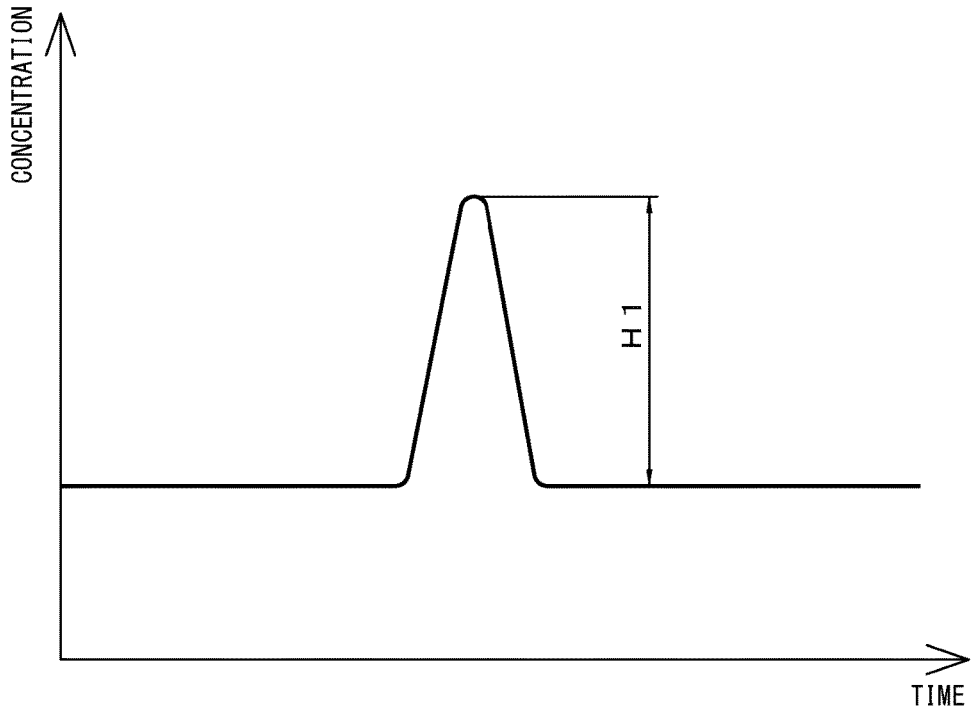
FIG. 3 is a graph of the measured concentration in the upstream side of the fluid mixer in FIG. 2.
Figure 4:
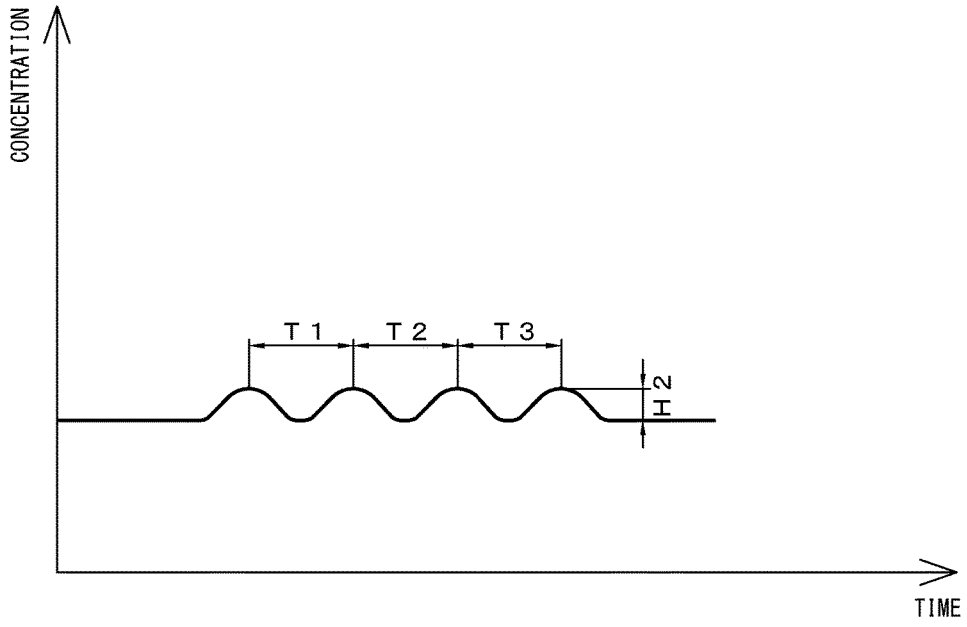
FIG. 4 is a graph of the measured concentration in the downstream side of the fluid mixer in FIG. 2.

FIG. 3 illustrates properties indicated by the concentration meter 20 installed in the upstream side of the fluid mixer. The horizontal axis indicates an elapsed time, and the vertical axis indicates a concentration. When the concentration is increased at a certain predetermined time, a peak (H1) as illustrated in FIG. 3 appears. FIG. 4 illustrates properties indicated by the concentration meter 21 installed in the downstream side of the fluid mixer. Referring to FIG. 4, the peak of the concentration is spread into four peaks, and the height of each peak (H2) is approximately one-quarter of the peak (H1).

An interval T1 between the peaks of the concentration corresponds to a time difference obtained by subtracting the time when a fluid that passes through the branching flow passage 7*a* arrives at the outlet of the branching flow passage 7*b* in the second flow passage 5, from the time when a fluid that passes over the protrusion 10*b* in the third flow passage 6 and passes through the branching flow passage 7*b* arrives at the outlet of the branching flow passage 7*b*, after the fluids pass through the position of the inlet of the branching flow passage 7*a* in the third flow passage 6. An interval T2 between the peaks of the concentration corresponds to a time difference obtained by subtracting the time when a fluid that passes through the branching flow passage 7*b* arrives at the outlet of the branching flow passage 7*c* in the second flow passage 5, from the time when a fluid that passes over the protrusion 10*c* in the third flow passage 6 and passes through the branching flow passage 7*c* arrives at the outlet of the branching flow passage 7*c*, after the fluids pass through the inlet of the branching flow passage 7*b* in the third flow passage 6. An interval T3 between the peaks of the concentration corresponds to a time difference obtained by subtracting the time when a fluid that passes through the branching flow passage 7*c* arrives at the outlet of the branching flow passage 7*d* in the second flow passage 5, from the time when a fluid that passes over the protrusion 10*d* in the third flow passage 6 and passes through the branching flow passage 7*d* arrives at the outlet of the branching flow passage 7*d*, after the fluids pass through the inlet of the branching flow passage 7*c* in the third flow passage 6. When the fluid mixer is not installed, the fluid flows almost without changing peak (H1), although the peak of the concentration illustrated in FIG. 3 may be slightly decreased by stirring by the flow of the fluid.

In the first embodiment, fluid is intended to flow from the fluid inlet 3 to the fluid outlet 8 by setting the fluid inlet 3 as an inlet into which fluid flows, and the fluid outlet 8 as an outlet from which fluid flows out. However, a similar effect can be obtained even when fluid is allowed to flow in the reverse direction. In such a case, the fluid outlet 8 is an inlet into which fluid flows, and the fluid inlet 3 is an outlet from which fluid flows out.

The fluid mixer of the first embodiment includes a small number of components, and can be easily produced. Since a flow passage structure is compact, the fluid mixer can be downsized, and pipes can be installed that save space. Even when the fluid mixer is connected to the pipes, installation of the pipes is completed only by connecting the pipes to the fluid inlet 3 and the fluid outlet 8 through joints or the like, respectively. Therefore, piping installation is easy, and the installation can be performed in a short time.

In the first embodiment, the delaying members 9 are placed in both the housing 2 and the element 1. However, the delaying members 9 may be placed in at least one of the housing 2 and the element 1. By placing the delaying members 9 in at least one of the housing 2 and the element 1, the fluid can be mixed and stirred so as to uniformly homogenize the concentration distribution and temperature distribution of fluid flowing in the fluid mixer in a flow direction.

Second Embodiment

Figure 5:
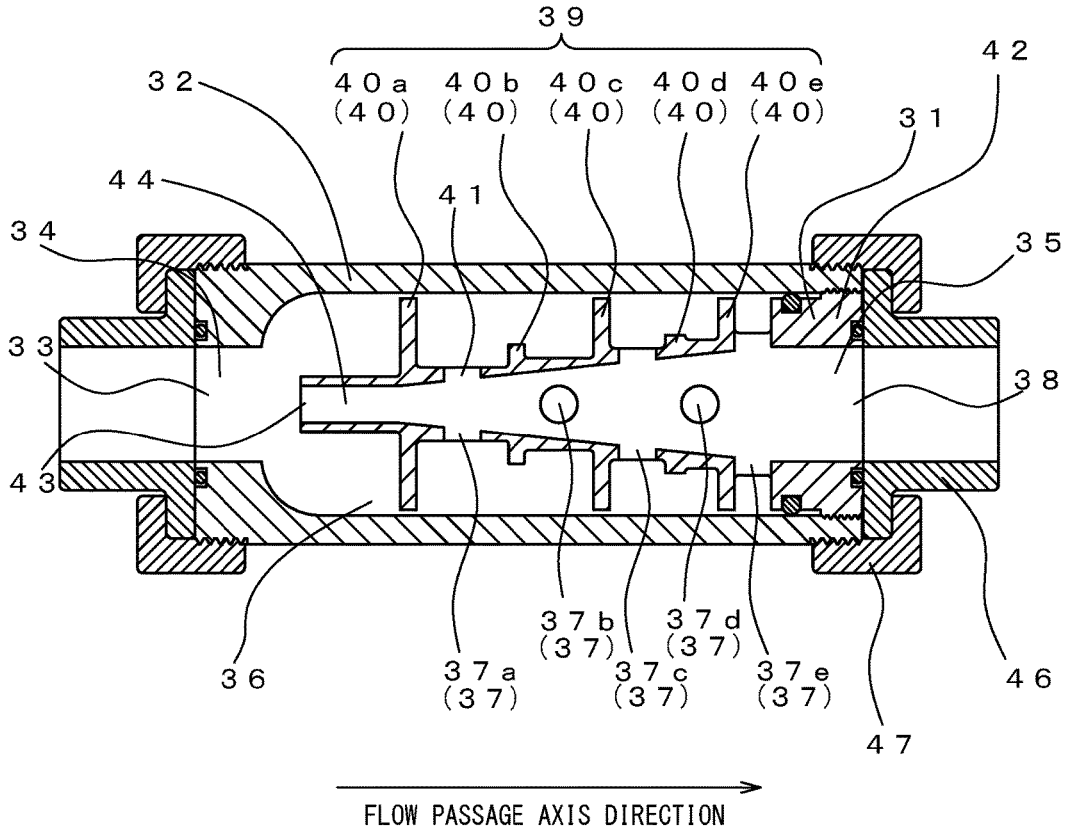
FIG. 5 is a vertical cross-sectional view illustrating the schematic configuration of a fluid mixer according to a second embodiment of the present invention.
Figure 6:
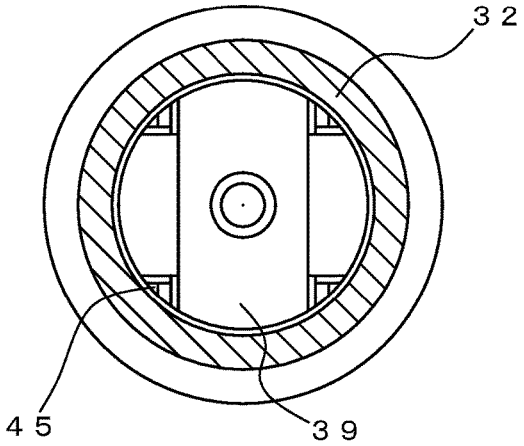
FIG. 6 is a transverse cross-sectional view illustrating the schematic configuration of the fluid mixer according to the second embodiment of the present invention.
Figure 7:
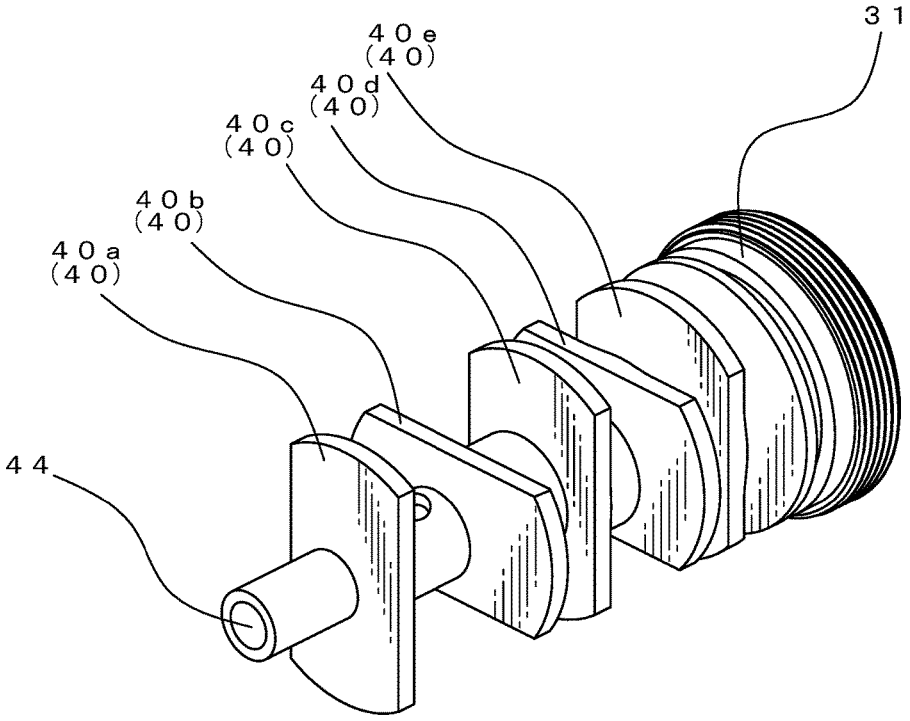
FIG. 7 is a perspective view illustrating the schematic configuration of an element in the second embodiment of the present invention.

A fluid mixer of a second embodiment of the present invention will be described below with reference to FIGS. 5 to 7. FIG. 5 is a vertical cross-sectional view illustrating the schematic configuration of the fluid mixer according to the second embodiment. FIG. 6 is a transverse cross-sectional view illustrating the schematic configuration of the fluid mixer according to the second embodiment. FIG. 7 is a perspective view illustrating the schematic configuration of an element 31 according to the second embodiment. The second embodiment differs from the first embodiment primarily in the shape of the element 31. Specifically, in the second embodiment, branching flow passages 37 and a second flow passage 35 are formed in the element 31, and plate-shaped protrusions 40 are formed as delaying members 39 on the outside of the element 31. Differences from the first embodiment will be primarily described below.

The element 31 is made of, for example, PVC. Unlike the first embodiment, the element 31 does not include a first flow passage forming part in which a fluid inlet 33 and a first flow passage 34 are formed, and the element 31 includes only a main body 42 in which a fluid outlet 38 and the second flow passage 35 are formed, in the second embodiment. The main body 42 has a substantially truncated cone shape in which cylindrical parts having different diameters are arranged in series with the central axes of the cylindrical parts that are aligned so that the diameters increase in a stepwise manner from an upstream side to a downstream side. Specifically, the cone surface of the substantially truncated cone shape has a step-formed shape including steps (step portions formed in interfaces between the cylindrical parts). An opening 43 is formed in one end face of the element 31, and the small-diameter part 44 of the second flow passage 35 is connected to the opening 43. The fluid outlet 38 is formed in the other end face of the element 31, and the second flow passage 35 is connected to the fluid outlet 38. The flow passage cross-sectional area of the second flow passage 35 gradually increases from the one end to the other end. In the outer peripheral surface of the other end of the element 31, a male threaded part for screwing the element 31 and a housing 32 to each other is formed, and an annular groove, into which an O-ring for maintaining an interface between the element 31 and the housing 32 in a water-tight state is fitted, is formed. In addition, an annular groove, into which an O-ring for maintaining the element 31 and a flanged short pipe 46 in a water-tight state is fitted, is formed in the other end face of the element 31.

The protrusions 40 serving as the delaying members 39 are formed in a substantially rectangular flat plate shape on the outer peripheral surface of the main body 42 of the element 31. When the protrusions 40 are formed in the plate shape, the many protrusions 40 can be arranged in a flow passage axis direction, and therefore, the arrangement of the protrusions 40 can be flexibly designed depending on properties and a type of fluid flowing through the fluid mixer. Two protrusions 40 are provided on the circumference of each step. The two protrusions 40 are arranged so as to have the same shape and be in opposite directions with respect to the center of the circumference. The width of protrusions 40 is formed to be larger than the diameter of the circumference of a portion of the main body 42 on which the protrusions 40 are arranged. The height of the protrusions 40 is formed so that a slight gap is formed between the ends of the protrusions 40 and the inner peripheral surface of the housing 32. "Slight gap" is a slight gap that enables edges of the protrusions 40 to be prevented from interfering with the inner peripheral surface of the housing 32, when the element 31 is inserted into the housing 32 so that the central axes of the element 31 and the housing 32 are aligned. In addition, the protrusions 40 are formed so that the closer a location where each protrusion 40 is arranged is to the downstream side, the wider the width of each protrusion 40 is, the lower the height of each protrusion 40 is, and the smaller the flow passage cross-sectional area of a third flow passage 36 on the circumference on which each protrusion 40 is formed is. In addition, the protrusions 40 adjacent to each other in the flow passage axis direction are arranged so that the protruding directions of the protrusions 40 are shifted circumferentially by 90° from each other. In addition, a linear gap flow passage 45 that does not interfere with the protrusions 40 is formed between the inner peripheral surface of the housing 32 and the outer peripheral surface of the main body 42, along the flow passage axis direction. In addition, communication holes 41 which serve as the branching flow passages 37 which allow the second flow passage 35 and the third flow passage 36 to communicate with each other are formed between the protrusions 40 adjacent to each other in the flow passage axis direction so that the shortest distance between the communication holes 41 is achieved.

The housing 32 is made of, for example, PVC. In the second embodiment, the housing 32 is formed in a cylindrical shape. An opening in one end face of the housing 32 serves as the fluid inlet 33, and the first flow passage 34 is formed in the one end of the housing 32. In other words, the one end of the housing 32 serves as a first flow passage forming part. In such a case, the first flow passage 34 shares the same central axis with the second flow passage 35. The inner diameter of the one end of the housing 32 is formed to be substantially equal to the bore of a pipe connected to the upstream side of the fluid mixer, and the inner diameter between an intermediate portion and the other end is formed to be generally equal to the outer diameter of the other end of the element 31. The inner peripheral surface of the housing 32 is formed of a smooth face without unevenness, a space defined between the inner peripheral surface of the housing 32 and the outer peripheral surface of the main body 42 serves as the third flow passage 36, and the flow passage cross-sectional area of the third flow passage 36 tends to decrease from the upstream side to the downstream side. The flanged short pipes 46, which serve as connectors that connect the housing 32 and pipes in the upstream and downstream sides of the housing 32 to each other, respectively, are connected to both ends of the housing 32. Female threaded parts for screwing cap nuts 47 which hold and fix the element 31, the housing 32, and the flanged short pipe 46 together are formed on the outer peripheral surface of both ends of the housing 32. An annular groove, into which an O-ring for maintaining the housing 32 and the flanged short pipe 46 in a water-tight state is fixed, is formed in the one end face of the housing 32. A female threaded part for screwing the element 31 and the housing 32 to each other is formed in the inner peripheral surface of the other end of the housing 32.

The operation of the fluid mixer of the second embodiment of the present invention will now be described.

A flowing chemical liquid having a partly high concentration in a flow passage flows from the fluid inlet 33 into the first flow passage 34, and flows downstream. When the chemical liquid flows downstream, the chemical liquid flowing through the first flow passage 34 is divided into a chemical liquid flowing into the small-diameter part 44 of the second flow passage 35, and a chemical liquid flowing into the third flow passage 36, and the divided chemical liquids flow through the corresponding flow passages. The chemical liquid flowing through the small-diameter part 44 flows downstream through the second flow passage 35, and is discharged from the fluid outlet 38 earlier than the chemical liquid flowing into the third flow passage 36.

The chemical liquid other than the chemical liquid flowing into the small-diameter part 44 flows through the third flow passage 36. The chemical liquid flowing into the third flow passage 36 is divided into a chemical liquid which collides with a protrusion 40*a*, and a chemical liquid which further flows downstream through the third flow passage 36 without colliding with the protrusion 40*a*. The protrusion 40*a* can effectively obstruct fluid flow, since it is arranged so that the protruding direction of the protrusions is approximately orthogonal to the flow passage axis from the circumference of the outer peripheral surface of the main body 42. The chemical liquid, which has collided with and been obstructed by the protrusion 40*a*, detours around the protrusion 40*a* and further flows downstream through the third flow passage 36. In other words, the chemical liquid, which has collided with and been obstructed by the protrusion 40*a*, flows downstream through the third flow passage 36 later than the chemical liquid further flowing downstream through the third flow passage 36 without colliding with the protrusion 40*a*. When a portion having a high chemical liquid concentration flows through a section connected to a branching flow passage 37*a*, a part of the chemical liquid that has passed over the protrusion 40*a* flows through the branching flow passage 37*a*, passes through the second flow passage 35, and flows to the fluid outlet 38. In such a case, since the flow of the chemical liquid flowing from the branching flow passage 37*a* to the second flow passage 35 is obstructed by the protrusion 40*a* serving as the delaying member 39 and then flows into the branching flow passage 37*a*, the chemical liquid flows out from the fluid outlet 38 later than the chemical liquid flowing through the small-diameter part 44 of the second flow passage 35.

The rest of the chemical liquid is divided into a chemical liquid which collides with and is obstructed by a protrusion 40*b*, and a chemical liquid which further flows downstream through the third flow passage 36 without colliding with the protrusion 40*b*. In the second embodiment, the protrusions 40*a* and 40*b* adjacent to each other in the flow passage axis direction are arranged so that the protruding directions of the protrusions are shifted circumferentially by 90° from each other, and therefore, the chemical liquid that has passed through the protrusion 40*a* without colliding therewith easily collides with the protrusion 40*b*. In other words, the flow of the chemical liquid can be effectively obstructed, and the flow of the chemical liquid to the downstream side of the third flow passage 36 can be effectively delayed. The chemical liquid, which has collided with and been obstructed by the protrusion 40*b*, detours around the protrusion 40*b*, and further flows downstream through the third flow passage 36. When a portion having a high chemical liquid concentration flows through a section connected to a branching flow passage 37*b*, a part of the chemical liquid that has passed through the protrusion 40*b* flows through the branching flow passage 37*b*, passes through the second flow passage 35, and flows to the fluid outlet 38. In such a case, since the flow of the chemical liquid is obstructed by the protrusion 40*b* serving as the delaying member 39 and then flows into the branching flow passage 37*b*, the chemical liquid flowing from the branching flow passage 37*b* to the second flow passage 35 is discharged from the fluid outlet 38 later than the chemical liquid flowing from the branching flow passage 37*a* to the second flow passage 35.

The rest of the chemical liquid flows downstream through the third flow passage 36 in a manner similar to those of the chemical liquids passing through the protrusions 40*a* and 40*b*. Specifically, when the chemical liquid approaches protrusions 40*c*, 40*d* and 40*e*, the chemical liquid is divided into a chemical liquid which collides with the protrusions 40*c*, 40*d* and 40*e*, and a chemical liquid which flows downstream through the third flow passage 36 without colliding with the protrusions 40*c*, 40*d* and 40*e*. The chemical liquid that has collided with the protrusions 40*c*, 40*d* and 40*e* detours around the protrusions 40*c*, 40*d* and 40*e*, and further flows downstream through the third flow passage 36. When portions having a high chemical liquid concentration flow through sections connected to branching flow passages 37*c*, 37*d* and 37*e*, the portions that has passed through the protrusions 40*c*, 40*d* and 40*e* flow through the branching flow passages 37*c*, 37*d* and 37*e*, so that a part of the portions flows through the branching flow passages 37*c* and 37*d*, passes through the second flow passage 35, and flows to the fluid outlet 38, and all of the rest flows through the branching flow passage 37*e*, passes through the second flow passage 35, and flows to the fluid outlet 38. In such a case, the chemical liquid flowing from the branching flow passages 37*c*, 37*d* and 37*e* to the second flow passage 35 is discharged from the fluid outlet 38 so that time differences are caused, respectively, because the flow of the chemical liquid is obstructed by the protrusions 40*c*, 40*d* and 40*e* and then flows into the branching flow passages 37*c*, 37*d* and 37*e*. A description of the operation of uniformly homogenizing the concentration distribution of fluid in a flow direction in the second embodiment is omitted because the operation is similar to that of the first embodiment.

In the second embodiment, there can be set a time difference between the time when the chemical liquid, which flows from the small-diameter part 44 into the second flow passage 35, flows out from the fluid mixer, and the time when the chemical liquid, which flows into the third flow passage 36, is obstructed by the protrusions 40, and flows from the branching flow passages 37 into the second flow passage 35, flows out from the fluid mixer. Because the protrusions 40 are discontinuously formed in the flow passage axis direction, a portion of the chemical liquid may collide with the protrusions 40 with a high frequency, and a portion of the chemical liquid may also collide with the protrusions 40 with a low frequency. Accordingly, time differences between when chemical liquids flow out from the fluid mixer can be set based on a frequency that a chemical liquid flowing through the third flow passage 36 collides with the protrusions 40. In the second embodiment, the linear gap flow passage 45 that does not interfere with the protrusions 40 is formed from the upstream side to the downstream side along the flow passage axis between the inner peripheral surface of the housing 32 and the outer peripheral surface of the main body 42. There can be set a time difference between the time when a chemical liquid flowing through the gap flow passage 45 flows out from the fluid mixer, and the time when a chemical liquid flowing through the third flow passage 36 and obstructed by the collisions with the protrusions 40 flows out from the fluid mixer, because the chemical liquid flowing through the gap flow passage 45 flows through the third flow passage 36 without being obstructed by the protrusions 40. In other words, the fluid mixer of the second embodiment branches, into a plurality of chemical liquids, a chemical liquid flowing into the fluid mixer and having a partly high chemical liquid concentration, and allows the branched chemical liquids to flow out with time difference, respectively, whereby the concentration distribution thereof in a flow direction can be effectively uniformly homogenized.

Figure 8:
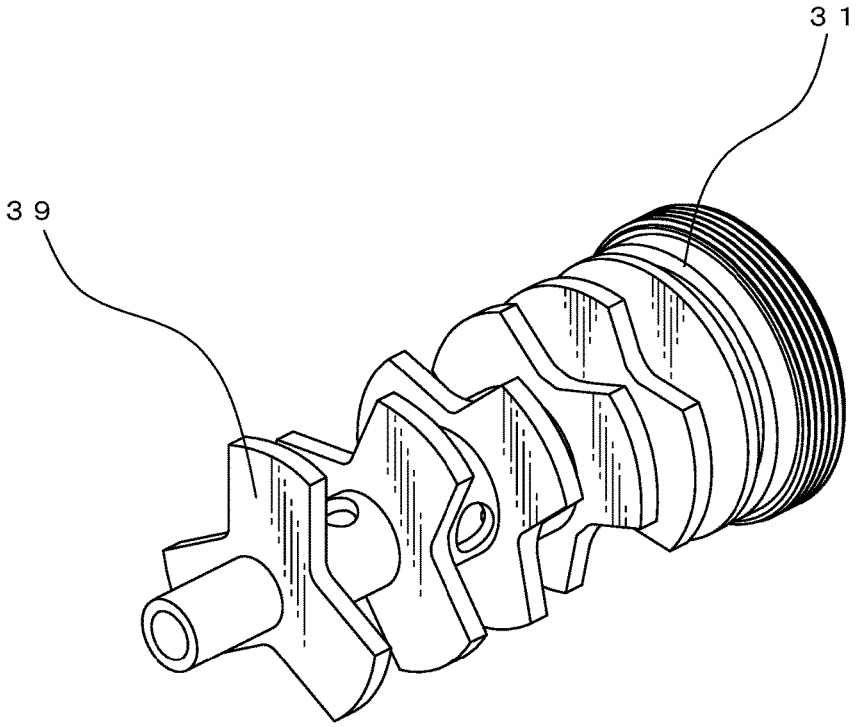
FIG. 8 is a perspective view illustrating the schematic configuration of an alternative example of the element in the second embodiment of the present invention.

In the second embodiment, each of the circumferences is provided with two protrusions 40, and the protruding directions of the protrusions 40 that are adjacent to each other in the flow passage axis direction are shifted circumferentially by 90° from each other. However, as illustrated in FIG. 8, each of the circumferences of the steps may be provided with three protrusions 40, and the protrusions 40 that are adjacent to each other in the flow passage axis direction may be arranged at positions shifted circumferentially by 60° from each other. As described above, the number of protrusions 40 provided on the same circumference and an angle by which the protrusions 40 are shifted are not limited.

In the second embodiment, the protrusions 40 are formed in a substantially rectangular plate shape. However, a protrusion 40 may be formed in any shape and is not limited, as long as the flow of fluid can be obstructed by the protrusion 40. For example, protrusions 40 may be formed in shapes such as semicircular plate shapes, shapes in which pores, notches, or recesses are formed in a plate, shapes in which a plate is curved or bent, and block shapes having various outer shapes. Like the shape of the protrusion 40, the height, width, and size of the protrusion 40 may be set at any height, width, and size and are not limited, as long as the flow of fluid can be obstructed by the protrusion 40. In addition, a plurality of protrusions 40 may be discontinuously arranged in a flow passage axis direction, and the arrangement of the protrusions 40 is not limited. For example, protrusions 40 having different shapes may be arranged irregularly. In other words, the shapes, arrangement, and the like of protrusions 40 can be designed as appropriate depending on the flow volume, flow rate, properties, necessary degree of mixture, and the like of fluid flowing through a fluid mixer.

In the second embodiment, the flow passage cross-sectional area of the third flow passage 36 on the circumference on which the protrusions 40 are provided decreases from the upstream side to the downstream side. In addition, the flow passage cross-sectional area of the third flow passage 36 tends to decrease as it goes to the downstream, because the third flow passage 36 is defined by the inner peripheral surface of the housing 32 and the outer peripheral surface of the main body 42. Accordingly, a chemical liquid flowing through the third flow passage 36 can be prevented from staying in the downstream side, and the chemical liquid can be smoothly led to the second flow passage 35.

In the second embodiment, all the branching flow passages 37 have the same inner diameter. However, the inner diameter of each branching flow passage 37 may be changed in order to regulate the flow volume of a chemical liquid flowing through each branching flow passage 37, without particular limitation. The positions, number, and lengths, of the branching flow passages 37, the connection angles between the branching flow passages 37 and the second flow passage 35, and the like are not limited, and may be designed as appropriate.

Third Embodiment

Figure 9:
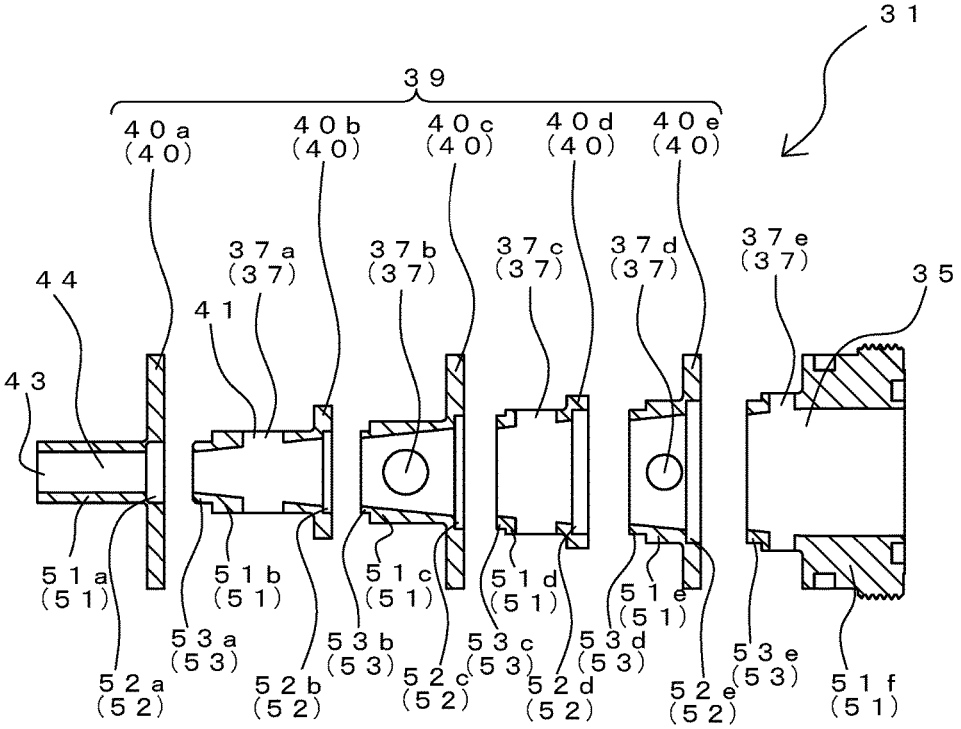
FIG. 9 is an exploded vertical cross-sectional view illustrating the schematic configuration of an element in a third embodiment of the present invention.

A fluid mixer of a third embodiment of the present invention will be described below with reference to FIG. 9. FIG. 9 is an exploded vertical cross-sectional view illustrating the schematic configuration of an element 31 in the third embodiment. The third embodiment differs from the second embodiment primarily in the shape of the element 31. Specifically, the element 31 is formed of cylindrical members 51 in the third embodiment, and the components of the third embodiment are similar to those of the second embodiment except for the element 31. Differences between the element 31 of the second embodiment and the element 31 of the third embodiment will be described below. A description of the components other than the element 31 and a description of the drawing of the components are omitted. Components exhibiting the same functions as those in the second embodiment are denoted by the same reference characters.

The shape of the element 31 is similar to the shape of the element 31 in the second embodiment. However, the element is formed by connecting a plurality of members together. The element 31 is formed by connecting the cylindrical members 51 having different diameters together in series with the central axes of cylindrical parts that are aligned so that the diameters gradually increase from an upstream side to a downstream side.

A cylindrical member 51*a* in the uppermost stream side is formed in a cylindrical shape. A through-hole which serves as the small-diameter part 44 of a second flow passage 35 is formed in the cylindrical member 51*a*. An opening 43 is formed in one end face of the cylindrical member 51*a*, and a socket 52*a* that is connected to a cylindrical member 51*b* located downstream of the cylindrical member 51*a* is formed in the other end. On the circumference of an outer peripheral surface of the other end of the cylindrical member 51*a*, two protrusions 40*a* formed in a plate shape are provided as delaying members 39 in opposite directions with respect to the center of the circumference.

The cylindrical member 51*b* located downstream of the cylindrical member 51*a* is formed in a cylindrical shape. In the cylindrical member 51*b*, a through-hole which serves as part of the second flow passage 35 communicating with the small-diameter part 44 is formed in a truncated cone shape of which the diameter gradually increases from an upstream side to a downstream side. A plug unit 53*a* that is connected to the socket 52*a* of the cylindrical member 51*a* is formed in one end of the cylindrical member 51*b*, and a socket 52*b* that is connected to a cylindrical member 51*c* located downstream of the cylindrical member 51*b* is formed in the other end. Two protrusions 40*b* formed in a plate shape are provided on the circumference of an outer peripheral surface of the other end of the cylindrical member 51*b* in opposite directions with respect to the center of the circumference. In addition, a communication hole 41 which serves as a branching flow passage 37*a* is formed in the outer peripheral surface of the cylindrical member 51*b*.

The cylindrical members 51*c*, 51*d*, and 51*e* are formed the same as the cylindrical member 51*b*. Specifically, a through-hole having a truncated cone shape, which serves as a part of the second flow passage 35, is formed in each of the cylindrical members 51*c*, 51*d*, and 51*e*. Plug units 53*b*, 53*c* and 53*d* are formed in one ends of the cylindrical members 51*c*, 51*d* and 51*e*, in order to connect to the sockets 52 of the cylindrical member 51 located upstream of each of the cylindrical members 51*c*, 51*d* and 51*e*, and sockets 52*c*, 52*d*, and 52*e* are formed in the other ends, in order to connect to the cylindrical member 51 located downstream of each of the cylindrical members 51. On each of the circumferences of the outer peripheral surfaces of the other ends of cylindrical members 51*c*, 51*d* and 51*e*, two protrusions 40*c*, 40*d* and 40*e* which are formed in a plate shape are provided in opposite directions with respect to the centers of the circumferences. Communication holes 41 which serve as branching flow passages 37*b*, 37*c* and 37*d* are formed on the outer peripheral surfaces of the cylindrical members 51*c*, 51*d* and 51*e*.

A cylindrical member 51*f* in the downmost stream side is formed in a cylindrical shape. A through-hole which serves as part of the second flow passage 35 communicating with a fluid outlet 38 is formed in the cylindrical member 51*f*. A plug unit 53*e* for connecting to the socket 52*e* of the cylindrical member 51*e* is formed in one end of the cylindrical member 51*f*. In an outer peripheral surface of the other end of the cylindrical member 51*f*, a male threaded part for screwing the element 31 and a housing to each other is formed, and an annular groove, into which an O-ring for maintaining the element 31 and the housing in a water-tight state is fixed, is formed. In addition, an annular groove, into which an O-ring for maintaining the element 31 and a short collared pipe in a water-tight state is fixed, is formed in the other end face of the cylindrical member 51*f*. In addition, a communication hole which serves as a branching flow passage 37*e* is formed in the outer peripheral surface of the cylindrical member 51*f*.

The element 31 is formed by connecting the respective cylindrical members 51 together with connecting the socket 52 of the respective cylindrical members 51 to the plug unit 53 corresponding to the respective sockets 52. In such a case, the cylindrical members 51 are connected to each other so that the protruding directions of the protrusions 40 that are adjacent to each other in the flow passage axis direction are shifted circumferentially by 90° from each other. The second flow passage 35 including the through-holes formed in the respective cylindrical members 51 includes a smooth inner peripheral surface without any step. The element 31 includes steps formed between the cylindrical members 51 by connecting the cylindrical members 51 having different outer diameters. Since each protrusion 40 is formed on the other end of each cylindrical member 51, the protrusions 40 are to be formed at the step portions. To form the protrusions 40 at the step portions enables the protrusions 40 to be supported by the one end faces of the cylindrical members 51 located downstream of the protrusions 40, and enables the protrusions 40 to be prevented from being deformed or damaged even when a chemical liquid collides with the protrusions 40.

In the third embodiment, the element 31 is divided into the plurality of cylindrical members 51, and therefore, the element 31 can be formed by a general cutting machine or injection molding machine even when the element 31 is large. In addition, the cylindrical members 51 are formed in a cylindrical shape, and therefore, cutting is easy, whereby a machining time can be shortened.

In the third embodiment, the similar protrusions 40 are provided on the cylindrical members 51. However, the shapes, arrangement, and the like of the protrusions 40 can be designed as appropriate, and are not limited. In the third embodiment, the protrusions 40 are formed integrally on the cylindrical members 51. However, the protrusions 40 may be components different from the cylindrical members 51, and the protrusions 40 and the cylindrical members 51 may be connected together by means such as fitting or adhesion. The cylindrical member 51 may be formed by any method, which is not limited. For example, mass production is facilitated by designing the shapes of the protrusion 40 and each flow passage can be injection molded, and producing the cylindrical members 51 by injection molding. Low-volume high-variety production is facilitated by producing the cylindrical members 51 by cutting. A description of the operation of the fluid mixer and the action of uniformly homogenizing the concentration distribution of fluid in a flow direction in the third embodiment is omitted because they are similar to those in the first embodiment and the second embodiment.

Apparatuses using the above-described fluid mixers will now be described with reference to FIG. 10 and FIG. 11.

The fluid mixers according to the embodiments of the present invention are applied into, for example, a line in which the temperature or concentration of fluid varies with time. Specifically, the fluid mixers according to the embodiments of the present invention are applied to, for example, a fluid which is a liquid heated by a heater installed in a line and of which the temperature varies with time due to occurrence of the unevenness of the temperature of the fluid with respect to a time axis, or a fluid in which the concentration of a substance, which is eluted from a solid constituted by the substance, varies with time, wherein the solid immersed in a tank is eluted by the fluid and set to flow in a line. The temperatures or concentrations of the fluids in the lines can be homogenized by using the fluid mixers. A substance flowing through the fluid mixers as fluid is not limited as long as it is a gas or a fluid.

Figure 10:
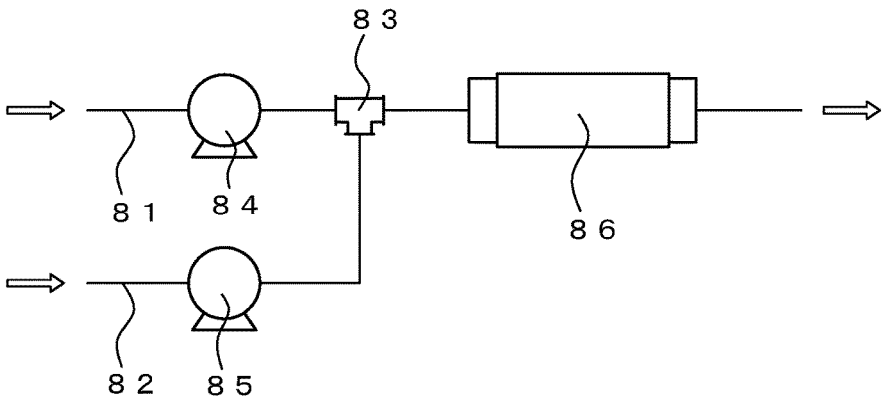
FIG. 10 is a schematic view illustrating an embodiment of an apparatus using a fluid mixer of the present invention.

FIG. 10 is a view illustrating an example of an apparatus using a fluid mixer according to the present invention. In FIG. 10, a fluid mixer 86 according to the present invention is arranged downstream of a joint part 83 of lines 81 and 82 through which two fluids flow, respectively. The fluids are supplied by pumps 84 and 85, respectively. Therefore, the mixing ratio of the fluids upon joining may vary with time, due to for example pulsation of the pumps 84 and 85. However, temperature and concentration can be homogenized with respect to a time axis by homogenizing the mixing ratio of the fluids by the fluid mixer 86. It is also effective for, for example, a case in which a high-temperature fluid and a low-temperature fluid are set to flow in lines 81, 82, respectively, and an uneven flow of the high-temperature fluid causes the unevenness of the temperature of the fluid with respect to a time axis, or a case in which the concentration of mixed fluid varies with time when a fluid having a given concentration is mixed with another fluid. A fluid in such a case may be any of, for example, a gas, a liquid, a solid or a powder. The solid and the powder may be mixed with the gas or the liquid in advance. The apparatus may be configured so that lines through which three or more fluids flow are joined, thereby mixing the three or more fluids by the fluid mixer.

Figure 11:
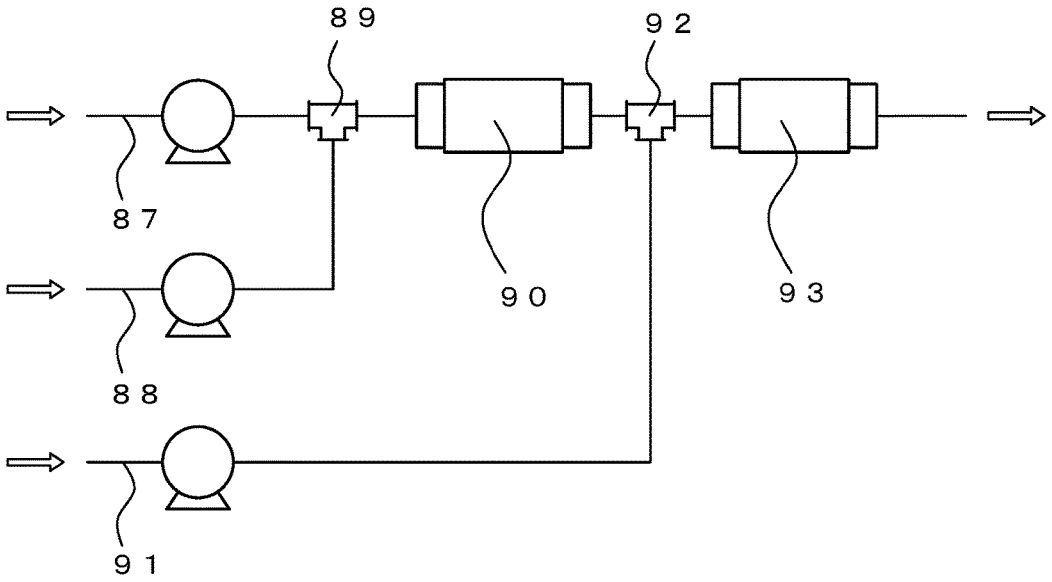
FIG. 11 is a schematic view illustrating an alternative example of the embodiment of the apparatus using the fluid mixer of the present invention.
Figure 12:
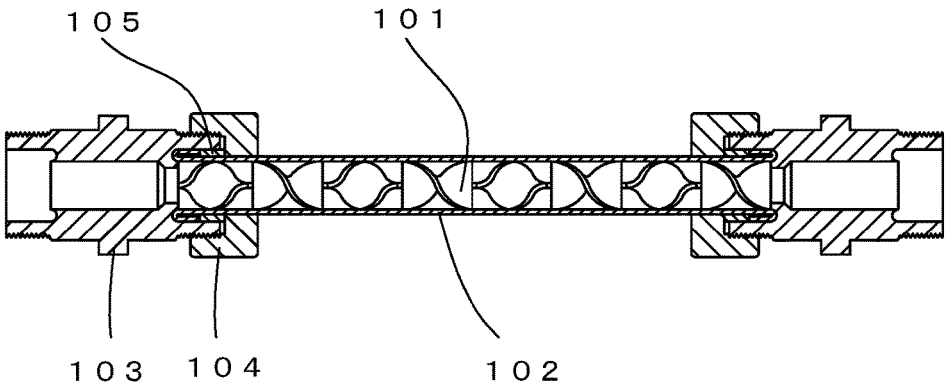
FIG. 12 is a vertical cross-sectional view illustrating a conventional fluid mixer.
Figure 13A:
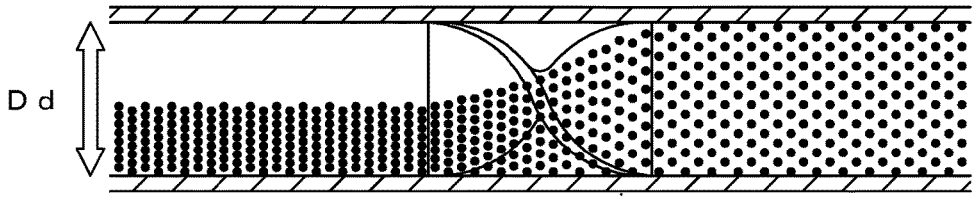
FIG. 13A is a schematic view illustrating the state of a stirred fluid in the static mixer in FIG. 12.
Figure 13B:
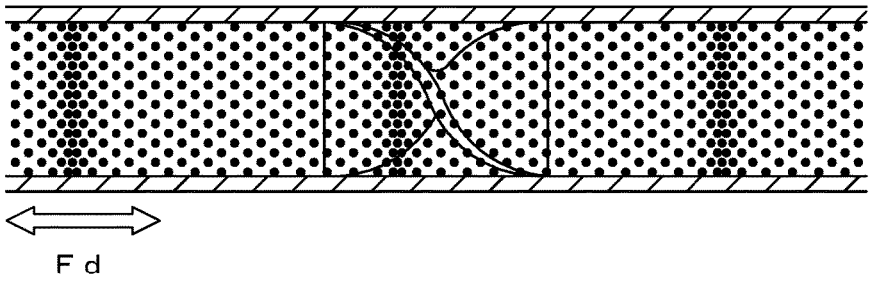
FIG. 13B is a schematic view illustrating the state of the stirred fluid in the static mixer in FIG. 12.

FIG. 11 is a view illustrating an alternative example of the apparatus in FIG. 10. In FIG. 11, a fluid mixer 90 according to the present invention is arranged downstream of a joint part 89 of lines 87 and 88 through which two fluids flow, respectively. A fluid mixer 93 according to the present invention is also arranged downstream of a joint part 92, wherein the joint part 92 is provided downstream of the fluid mixer 90 and a line 91 through which the other fluid flows is joined to the joint part 92. As a result, when mixture unevenness is caused by simultaneously mixing the three or more fluids, homogeneous fluid without mixture unevenness can be efficiently obtained by homogeneously mixing two fluids for first mixture and then homogeneously mixing the resultant with the other fluids. For example, when water, oil and a surfactant are mixed, mixing of all of them at one time results in insufficient mixing and uneven mixture. They can be uniformly homogeneously mixed by mixing the water with the surfactant in advance and then mixing the mixture with the oil. The apparatus can also be preferably used, for example, in a case in which water and sulfuric acid are mixed and diluted and then the mixture is mixed with ammonia gas to absorb the ammonia gas, or in a case in which water and sulfuric acid are mixed and diluted and then the mixture is mixed with silicate soda to adjust its pH. Three or more fluids may initially be joined, and two or more fluids may be joined on the way. Three or more fluid mixers may be arranged in series to mix other fluids in a stepwise manner.

Combinations of different fluids to be mixed by the apparatus will be further described. In the apparatus in FIG. 10, water may be set to flow through the line 81 through which one fluid flows, and any one of a pH adjuster, a liquid fertilizer, a bleaching agent, a germicide, a surfactant, and a chemical liquid may be set to flow through the line 82 through which the other fluid flows.

In such a case, the water is not limited as long as it is water conforming to the conditions of a substance to be mixed, such as pure water, distilled water, tap water, or industrial water. The temperature of the water is not limited, and the water may be warm water or cold water. The pH adjuster may be an acid or alkali used for adjusting the pH of liquid to be mixed, and examples thereof include aqueous solutions of hydrochloric acid, sulfuric acid, nitric acid, hydrofluoric acid, carboxylic acid, citric acid, gluconic acid, succinic acid, potassium carbonate, sodium hydrogen carbonate, and sodium hydroxide. The liquid fertilizer may be an agricultural liquid fertilizer, and examples thereof include feces and urine, and chemical fertilizers.

The bleaching agent may be an agent that decomposes pigments with the utilization of oxidation or reduction reaction of a chemical substance, and examples thereof include sodium hypochlorite, sodium percarbonate, hydrogen peroxide, ozone water, thiourea dioxide, and sodium dithionite. The germicide is an agent for killing microorganisms having pathogenicity or harmfulness, and examples thereof include iodine tincture, povidone iodine, sodium hypochlorite, chlorinated lime, mercurochrome solution, chlorhexidine gluconate, acrinol, ethanol, isopropanol, hydrogen peroxide water, benzalkonium chloride, cetylpyridinium chloride, saponated cresol solution, sodium chlorite, hydrogen peroxide, sodium hypochlorite, hypochlorous acid water, and ozone water.

The surfactant is a substance including a portion (hydrophilic group) having an affinity for water and a portion (lipophilic group, hydrophobic group) having an affinity for oil in the molecule, and examples thereof include fatty acid sodium, fatty acid potassium, monoalkyl sulfate, alkyl polyoxyethylene sulfate, alkyl benzene sulfonate, monoalkyl phosphate, alkyltrimethylammonium salt, dialkyldimethylammonium salt, alkylbenzyldimethylammonium salt, alkyldimethylamine oxide, alkylcarboxybetaine, polyoxyethylene alkyl ether, sorbitan fatty acid ester, alkyl polyglucoside, fatty acid diethanolamide, alkyl monoglyceryl ether, sodium alpha-sulfo fatty acid ester, straight-chain sodium alkylbenzene sulfonate, sodium alkyl ether sulfate, sodium alpha-olefin sulfonate, sodium alkylsulfonate, sucrose fatty acid ester sorbitan fatty acid ester, polyoxyethylene sorbitan fatty acid ester, fatty acid alkanolamide, polyoxyethylene alkyl ether, polyoxyethylene alkyl phenyl ether, alkylamino fatty acid sodium, alkyl betaine, alkyl amine oxide, alkyltrimethylammonium salt, and dialkyldimethylammonium salt.

Chemical liquids that do not fall within the above-described category may be used as long as falling within the category of chemical liquid, and examples thereof include hydrochloric acid, sulfuric acid, acetic acid, nitric acid, formic acid, hydrofluoric acid, sodium hydroxide, potassium hydroxide, calcium hydroxide, barium hydroxide, ammonium hydroxide, silicate soda, and oils. The mentioned chemical liquids may be used as chemical liquids falling within the above-described category. Water may be set to flow through the line 81 through which the one fluid flows, hot water may be set to flow through the line 82 through which the other fluid flows, and water and hot water may be mixed to have even and constant temperature.

A first chemical liquid may be set to flow through the line 81 through which the one fluid flows, and a second chemical liquid or a metal may be set to flow through the line 82 through which the other fluid flows, to mix them by the fluid mixer 86. The first and second chemical liquids may be mixable chemical liquids, and may be the above-described chemical liquids or other chemical liquids. Examples of the chemical liquids include photoresists and thinners. The chemical liquids may be cosmetics. Examples of the cosmetics include: basic cosmetics for caring for the skin itself, such as facial cleansers, cleansing creams, lotions, liquid cosmetics, milky lotions, creams, and gels; and medicated cosmetics falling under quasi drugs, for example, for prevention of bad breath, body odor, prickly heat, sores and loss of hair, for hair restoration or hair removal, and for rats and pest control.

The metal is primarily an organometallic compound. A liquid obtained by dissolving fine granules or powders in an organic solvent or the like is used. Examples of the organometallic compound include: organozinc compounds such as chloro(ethoxycarbonylmethyl)zinc; organocopper compounds such as lithium dimethylcuprate; organomagnesium compounds such as Grignard reagent, methylmagnesium iodide, and diethylmagnesium; organolithium compounds such as n-butyllithium; organometallic compounds such as metal carbonyl, carbene complexes, and metallocenes such as ferrocene; and single-element- or multi-element-mixed standard solutions dissolved in paraffin oil. Examples of the organometallic compound also include: compounds of metalloids such as silicon, arsenic, and boron; and base metals such as aluminum. Such organometallic compounds are preferably used as catalysts in production of petrochemical products or organic polymers.

A waste liquid may be set to flow through the line 81 through which the one fluid flows, and a pH adjuster or a flocculant may be set to flow through the line 82 through which the other fluid flows, to mix them by the fluid mixer 86. For example, such a pH adjuster as described above is used as the pH adjuster. The flocculant is not limited as long as it enables the waste liquid to flocculate, and examples thereof include aluminum sulfate, iron(II) polysulfate, polyaluminum chloride, polysilica-iron, calcium sulfate, ferric chloride, and slaked lime. The microorganisms may be those promoting the fermentation or decomposition of a waste liquid, and examples thereof include fungi such as mold and yeast, and bacteria such as a bacterium.

A first petroleum oil may be set to flow through the line 81 through which the one fluid flows, and a second petroleum oil, an additive, or water may be set to flow through the line 82 through which the other fluid flows, to mix them by the fluid mixer 86. The first and second petroleum oils are liquid oils that contain hydrocarbon as the main component as well as small amounts of various substances such as sulfur, oxygen, and nitrogen, and examples thereof include naphtha (gasoline), kerosene, light oil, heavy oil, lubricating oil, and asphalt. The additive as used herein refers to that added for improving or keeping the quality of petroleum oils, and examples thereof include: lubricating oil additives such as cleaning dispersants, antioxidants, viscosity index improvers, pour-point depressants, oiliness improvers, extreme-pressure additives, anti-wear agents, and antirust/anticorrosive agents; grease additives such as structure stabilizers and fillers; and fuel oil additives. The water as used herein is not limited as long as it is water conforming to the conditions of a substance to be mixed, such as pure water, distilled water, city water, or industrial water. The temperature of the water is not limited, and the water may be warm water or cold water.

A first resin may be set to flow through the line 81 through which the one fluid flows, and a second resin, a solvent, a curing agent, or a coloring agent may be set to flow through the line 82 through which the other fluid flows, to mix them by the fluid mixer 86. The resin as used herein is a molten resin, the main component of an adhesive such as a liquid resin, or the coating film formation component of a coating. The molten resin is not limited as long as it is a resin that can be molded by injection molding or extrusion, and examples thereof include polyethylene, polypropylene, polyvinyl chloride, polystyrene, a tetrafluoroethylene/perfluoroalkyl vinyl ether copolymer, ABS resin, acrylic resin, polyamide, nylon, polyacetal, polycarbonate, modified polyphenylene ether, polybutylene terephthalate, polyethylene terephthalate, polyphenylene sulfide, and polyether ether ketone.

Examples of the main component of an adhesive such as a liquid resin include acrylic resin adhesives, α-olefinic adhesives, urethane resin adhesives, ether cellulose, ethylene-vinyl acetate resin adhesives, epoxy resin adhesives, vinyl chloride resin solvent adhesives, chloroprene rubber adhesives, vinyl acetate resin adhesives, cyanoacrylate adhesives, silicone adhesives, water-based polymer/isocyanate adhesives, styrene-butadiene rubber solution adhesives, styrene-butadiene rubber latex adhesives, nitrile rubber adhesives, nitrocellulose adhesives, reactive hot melt adhesives, phenolic resin adhesives, modified silicone adhesives, polyamide resin hot melt adhesives, polyimide adhesives, polyurethane resin hot melt adhesives, polyolefin resin hot melt adhesives, polyvinyl acetate resin solution adhesives, polystyrene resin solvent adhesives, polyvinyl alcohol adhesives, polyvinylpyrrolidone resin adhesives, polyvinyl butyral resin adhesives, polybenzimidazole adhesives, polymethacrylate resin solution adhesives, melamine resin adhesives, urea resin adhesives, and resorcinol adhesives. Examples of the coating film formation component of a coating include acrylic resin, urethane resin, and melamine resin.

Examples of the solvent include hexane, benzene, toluene, diethyl ether, chloroform, ethyl acetate, tetrahydrofuran, methylene chloride, acetone, acetonitrile, dimethylsulfoxide, dimethylformamide, dimethylacetamide, N-methylpyrrolidone, ethanol, and methanol. Examples of the curing agent include polyamines, acid anhydrides, amines, peroxides, and saccharin. Examples of the coloring agent include pigments such as zinc white, white lead, lithopone, titanium dioxide, precipitated barium sulfate, baryta powder, red lead, iron oxide red, chrome yellow, zinc yellow, ultramarine blue, potassium ferric ferrocyanide, and carbon black.

When the above-described resin is a molten resin, an apparatus which allows the molten resin to flow from a molding machine or an extruder to the fluid mixer 86 may be prepared. For example, when the apparatus is a molding machine, the fluid mixer 86 may be arranged between the nozzle and die of the molding machine to perform injection molding. When the apparatus is an extruder, the fluid mixer 86 may be arranged between the extruder and a die to perform extrusion molding. In such a case, the temperature in the resin is homogenized and the viscosity of the resin is stabilized to be able to inhibit thickness unevenness, internal stress, and the like, and to be further able to eliminate color unevenness.

A first food ingredient may be set to flow through the line 81 through which the one fluid flows, and a second food ingredient, a food additive, a seasoning, a noncombustible gas, and the like may be set to flow through the line 82 through which the other fluid flows, to mix them by the fluid mixer 86.

The first and second food ingredients may be beverages or food that can flow into a pipe, and examples thereof include: alcoholic beverages such as sake, shochu, beer, whiskey, wine, and vodka; dairy products such as milk, yogurt, butter, cream, cheese, condensed milk, and milk fat; beverages such as juice, tea, coffee, soy milk, and water; beverage foods such as soup stock, miso soup, consomme soup, corn soup, and pork bone broth; and, in addition, various food ingredients such as jelly, konjac, pudding, chocolate, ice cream, candies, tofu, fish-paste products, beaten egg, and gelatin. The first and second food ingredients may be substances, powders, and the like as long as it is able to flow, and examples thereof include: powdered ingredients such as wheat flour, starch powder, hard flour, soft flour, buckwheat flour, powdered milk, coffee, and cocoa; and small solid foods such as fruit pulp, seaweed, sesame, green laver, dried bonito shavings, bread crumbs, and finely chopped or grated foods.

Examples of the food additive include: sweeteners such as brown sugar, yellow soft sugar, fructose, maltose, honey, syrup, maple syrup, thick malt syrup, erythritol, trehalose, maltitol, palatinose, xylitol, sorbitol, thaumatin, saccharin sodium, cyclamate, dulcin, aspartame, acesulfame-K, sucralose, and neotame; coloring agents such as caramel pigment, gardenia pigment, anthocyanin pigment, annatto pigment, paprika pigment, safflower pigment, monascus pigment, flavonoid pigment, cochineal pigment, amaranth, erythrosine, allura red AC, new coccine, phloxine, rose bengal, acid red, tartrazine, sunset yellow FCF, fast green FCF, brilliant blue FCF, and indigo carmine; preservatives such as sodium benzoate, ε-polylysine, milt protein extract (protamine), potassium sorbate, sodium, sodium dehydroacetate, and thujapricin (hinokitiol); antioxidants such as ascorbic acid, tocopherol, dibutylhydroxytoluene, butylated hydroxyanisole, sodium erythorbate, sodium sulfite, sulfur dioxide, chlorogenic acid, and catechin; and flavoring agents.

Examples of the seasoning include: liquids such as soy sauce, source, vinegar, oil, chili oil, miso, ketchup, mayonnaise, dressing, and sweet sake; and powders such as sugar, salt, pepper, Japanese pepper, and cayenne pepper. The microorganisms, which promote the fermentation or decomposition of foods, are: fungi such as mushrooms, mold, and yeast; and bacteria such as a bacterium. Examples of the fungi include various mushrooms and *aspergillus*, and examples of the bacteria include bifidobacteria, lactic acid bacteria, and *Bacillus natto*. Examples of the noncombustible gas include carbonic acid gas, which is used for, e.g., generating beer by mixing wort with carbonic acid gas.

Air may be set to flow through the line 81 through which the one fluid flows, and a combustible gas may be set to flow through the line 82 through which the other fluid flows, to mix them by the fluid mixer 86. Examples of the combustible gas include methane, ethane, propane, butane, pentane, acetylene, hydrogen, carbon monoxide, ammonia, and dimethyl ether.

A first noncombustible gas may be set to flow through the line 81 through which the one fluid flows, and a second noncombustible gas or vapor may be set to flow through the line 82 through which the other fluid flows, to mix them by the fluid mixer 86. Examples of the noncombustible gases include nitrogen, oxygen, carbon dioxide, argon gas, helium gas, hydrogen sulfide gas, sulfurous acid gas, and sulfur oxide gas. As another combination of the above-described case, water, a chemical liquid, or a food ingredient may be set to flow through the line 81 through which the one fluid flows, and air, a noncombustible gas, or vapor may be set to flow through the line 82 through the other fluid flows, to mix them by the fluid mixer 86.

A first synthetic intermediate may be set to flow through the line 81 through which the one fluid flows, and a second synthetic intermediate, an additive, a chemical liquid, a metal, or the like may be set to flow through the line 82 through which the other fluid flows, to mix them by the fluid mixer 86. The first and second synthetic intermediates refer to compounds that appear in multi-stage synthetic pathways to target compounds and that are at stages halfway through synthesis. Examples of the first and second synthetic intermediates include synthetic intermediates that are halfway through synthesis after mixture of chemicals, synthetic intermediates that are halfway through purification of resin, and pharmaceutical intermediates.

The above-described different fluids may be mixed using the apparatus in FIG. 11. In the apparatus using the fluid mixer in FIG. 10 or FIG. 11, a heater or a vaporizer may be disposed in the respective lines through which fluids before joining flow, or a heat exchanger may be disposed downstream of the fluid mixer. Further, a measurement instrument may be arranged in the line through which the one fluid before joining flows, and a control unit that adjusts the output of the pump on the line through which the other fluid flows depending on a parameter measured by the measurement instrument may be disposed; and a control valve may be arranged in the line through which the other fluid flows, and a control valve that adjusts the opening degree of the control valve depending on a parameter from a measurement instrument may be disposed. In such a case, the measurement instrument may be a flow meter, a current meter, a concentration meter, or a pH measurement instrument as long as it is able to measure the necessary parameter of fluid. A static mixer may be installed in the flow passage located downstream of the joint part of the lines. In such a case, the fluids can be more homogeneously mixed, because homogenization of mixture in the axial direction of the flow passage is performed by the fluid mixer, and then homogenization of mixture in the radial direction of the flow passage is performed by, for example, a static mixer as described in the beginning of the present specification.

The material of each component such as the housing 2, 32, or 62, or the element 1, 31, or 61 of the fluid mixer according to the present invention may be any of PVC, polypropylene, polyethylene, and the like as long as the component is made of resin. In particular, when corrosive fluid is used as the fluid, a fluororesin such as polytetrafluoroethylene or polyvinylidene fluoride is preferred. The fluororesin is preferred, because it can be used along with the corrosive fluid, and there is no concern about the corrosion of a pipe member even when corrosive gas permeates. A part of the housing 2, 32, 62 and the element 1, 31, 61 may be formed of a transparent or semi-transparent material. Such a case is preferred because the state of mixture of the fluid can be confirmed by visual observation. The material of each component may be a metal or an alloy such as iron, copper, copper alloy, brass, aluminum, stainless steel, or titanium depending on a substance to be set to flow through the fluid mixer.

A fluid mixer may be formed by arbitrarily combining the first embodiment to the third embodiment described above. In other words, the present invention is not limited to the fluid mixers of the embodiments as long as the characteristics and functions of the present invention can be achieved.

REFERENCE SIGNS LIST

1, 31 Element
2, 32 Housing
3, 33 Fluid inlet
4, 34 First flow passage
5, 35 Second flow passage
6, 36 Third flow passage
7, 37 Branching flow passage
8, 38 Fluid outlet
9, 39 Delaying member
10, 40 Protrusion
11, 41 Communication hole
12, 42 Main body

The invention claimed is:

1. A fluid mixer comprising:
a fluid inlet;
a first flow passage that is connected to the fluid inlet;
a second flow passage that is arranged so as to communicate with or be partitioned from the first flow passage and that is arranged to share the same central axis with the first flow passage;
a third flow passage that is connected to the first flow passage and that is arranged to an outer periphery of the second flow passage;
a plurality of branching flow passages that branch from the third flow passage and that are connected to the second flow passage; and
a fluid outlet that is connected to the second flow passage,
wherein the plurality of branching flow passages branch from different positions in the third flow passage, respectively, and are connected to the second flow passage at different positions in the second flow passage, respectively;
the fluid mixer comprises:
an element comprising:
a first flow passage forming part at an end of which the fluid inlet is formed and in an inside of which the first flow passage is formed; and
a main body formed in a substantially truncated cone shape at an end of which the fluid outlet is formed, in an inside of which the second flow passage is formed, and on an outer peripheral surface of which a plurality of communication holes are formed to allow the second flow passage and an outside to communicate with each other; and
a housing in an inside of which the element is housed and which engages with at least both ends of the element;
and wherein:
a plurality of delaying members comprising plate-shaped protrusions are discontinuously formed on at least one of an inner peripheral surface of the housing or an outer peripheral surface of the main body in a flow passage axis direction;
a single continuous space is formed between the inner peripheral surface of the housing and the outer peripheral surface of the main body, the space serving as the third flow passage; and
the communication holes serve as the branching flow passages.

2. The fluid mixer according to claim 1, wherein
circumferences of the outer peripheral surface of the main body are provided with at least two protrusions, respectively;
the protrusions adjacent to each other in the flow passage axis direction are arranged so that protruding directions of the protrusions are shifted to each other in the circumferential direction; and
a flow passage cross-sectional areas of the third flow passage on the circumferences gradually decrease from an upstream side to a downstream side.

3. The fluid mixer according to claim 1, wherein the main body comprises a step-formed shape in which a plurality of cylindrical parts having different diameters are arranged in series with central axes of the cylindrical parts are aligned so that the diameters of the cylindrical parts gradually increase from an upstream side to a downstream side.

4. The fluid mixer according to claim 3, wherein the protrusions are formed on steps of the step-formed shape.

5. The fluid mixer according to claim 1, wherein
the protrusions are arranged in opposite directions with respect to a center of the circumference of the main body on which the protrusions are arranged;
widths of the protrusions are formed to be greater than a diameter of the circumference on which the protrusions are arranged;
heights of the protrusions are formed so that gaps are formed between ends of the protrusions and the inner peripheral surface of the housing; and
the protrusions are arranged so that protruding directions of the protrusions adjacent to each other in the flow passage axis direction are shifted circumferentially by 90° from each other.

6. The fluid mixer according to claim 1, wherein a linear gap flow passage that does not interfere with the protrusions is formed between the inner peripheral surface of the housing and the outer peripheral surface of the main body from an upstream side to a downstream side of the main body along the flow passage axis direction.

7. The fluid mixer according to claim 1, wherein at least the delaying member of the element has a shape that can be injection molded.

8. An apparatus using a fluid mixer, the apparatus comprising:

the fluid mixer according to claim 1; and flow passage forming means that forms a flow passage through which a plurality of different fluids are joined and led to the fluid mixer.

9. A fluid mixer comprising:

a fluid inlet;

a first flow passage that is connected to the fluid inlet;

a second flow passage that is arranged so as to communicate with or be partitioned from the first flow passage and that is arranged to share the same central axis with the first flow passage;

a third flow passage that is connected to the first flow passage and that is arranged to an outer periphery of the second flow passage;

a plurality of branching flow passages that branch from the third flow passage and that are connected to the second flow passage; and a fluid outlet that is connected to the second flow passage, and wherein the plurality of branching flow passages branch from different positions in the third flow passage, respectively, and are connected to the second flow passage at different positions in the second flow passage, respectively;

the fluid mixer comprises:

an element comprising a main body formed in a substantially truncated cone shape at an end of which the fluid outlet is formed, in an inside of which the second flow passage is formed, and on an outer peripheral surface of which a plurality of communication holes are formed to allow the second flow passage and an outside to communicate with each other; and a housing that comprises a first flow passage forming part at an end of which the fluid inlet is formed and in an inside of which the first flow passage is formed, that houses the element therein, and that engages with at least an end of the element at which the fluid outlet is formed;

a plurality of delaying members comprising plate-shaped protrusions are discontinuously arranged on at least one of an inner peripheral surface of the housing or an outer peripheral surface of the main body in a flow passage axis direction;

a single continuous space is formed between the inner peripheral surface of the housing and the outer peripheral surface of the main body, the space serving as the third flow passage; and the communication holes serve as the branching flow passages.

10. The fluid mixer according to claim 9, wherein circumferences of the outer peripheral surface of the main body are provided with at least two protrusions, respectively;

the protrusions adjacent to each other in the flow passage axis direction are arranged so that protruding directions of the protrusions are shifted to each other in the circumferential direction; and a flow passage cross-sectional areas of the third flow passage on the circumferences gradually decrease from an upstream side to a downstream side.

11. The fluid mixer according to claim 9, wherein the main body comprises a step-formed shape in which a plurality of cylindrical parts having different diameters are arranged in series with central axes of the cylindrical parts are aligned so that the diameters of the cylindrical parts gradually increase from an upstream side to a downstream side.

12. The fluid mixer according to claim 11, wherein the protrusions are formed on steps of the step-formed shape.

13. The fluid mixer according to claim 9, wherein the protrusions are arranged in opposite directions with respect to a center of the circumference of the main body on which the protrusions are arranged;

widths of the protrusions are formed to be greater than a diameter of the circumference on which the protrusions are arranged;

heights of the protrusions are formed so that gaps are formed between ends of the protrusions and the inner peripheral surface of the housing; and the protrusions are arranged so that protruding directions of the protrusions adjacent to each other in the flow passage axis direction are shifted circumferentially by 90° from each other.

14. The fluid mixer according to claim 9, wherein a linear gap flow passage that does not interfere with the protrusions is formed between the inner peripheral surface of the housing and the outer peripheral surface of the main body from an upstream side to a downstream side of the main body along the flow passage axis direction.

15. The fluid mixer according to claim 9, wherein at least the delaying member of the element has a shape that can be injection molded.

16. An apparatus using a fluid mixer, the apparatus comprising:

the fluid mixer according to claim 9; and flow passage forming means that forms a flow passage through which a plurality of different fluids are joined and led to the fluid mixer.

* * * * *